United States Patent [19]

Jahn

[11] 4,153,091

[45] May 8, 1979

[54] MAILING POUCH

[76] Inventor: Gerhard Jahn, 133 Richmond St. West, Toronto, Ontario, Canada, M5H 2L7

[21] Appl. No.: 894,426

[22] Filed: Apr. 7, 1978

[51] Int. Cl.[2] ..... B65D 33/24

[52] U.S. Cl. ..... 150/21; 150/7; 206/37; 206/265

[58] Field of Search ..... 150/7, 21; 206/37, 265

[56] References Cited

U.S. PATENT DOCUMENTS

| | | | |
|---|---|---|---|
| 777,263 | 12/1904 | Mead | 150/7 |
| 1,370,966 | 3/1921 | Hirsch | 150/21 |
| 1,907,657 | 5/1933 | Ottinger | 150/7 |
| 1,984,150 | 12/1934 | Ottinger | 150/7 |

FOREIGN PATENT DOCUMENTS

| | | | |
|---|---|---|---|
| 206462 | 11/1923 | United Kingdom | 150/7 |

*Primary Examiner*—Ro E. Hart

[57] ABSTRACT

A mailing pouch comprises a pouch mouth closure flap integral with one of the pouch walls. The closure flap has a resilient portion associated therewith which is sufficiently flexible to permit insertion and withdrawal of the flap into and from the pouch mouth. The resilient portion provides resistance to flap withdrawal to thereby provide a mailing pouch having a closure without the need for snap fastener, zipper or the like and is marginally susceptible to accidental opening during mail handling.

16 Claims, 7 Drawing Figures

MAILING POUCH

FIELD OF THE INVENTION

This invention relates to mailing pouches and more particularly to mailing pouches which have a pouch mouth closure flap.

BACKGROUND OF THE INVENTION

Mailing pouches are widely used for mailing fragile goods. The problem with most types of mailing pouches is retaining the closure flap in the pouch mouth closed position during mail sorting, handling and delivery. Most pouches use a positive flap closure device such as straps, "Velcro" (trade mark) zippers, interlocking tabs on flap and pouch, and the like. In using such fastening devices the closure flap is external of the pouch so that the flap is susceptible to being caught during mail handling and opening the pouch. To overcome the accidental opening of pouches, in the past the positive flap closure devices, have been substantially strengthened, however, this makes it very difficult for people to open the pouch, particularly if the person is arthritic or handicapped.

Mailing pouches are particularly useful for return mailing of material once it has been examined. An example is the forwarding and return of cassette tapes to the blind from a central library. The cassettes may have a novel recorded on them; and the blind read the novel by listening to the cassettes. Presently the cassettes are forwarded and returned in a plastic box. Such boxes are bulky and have a very strong snap fastner to keep the box closed during mail handling. This presents a problem to the blind and other handicapped people because they have a great deal of difficulty opening the box.

SUMMARY OF THE INVENTION

The mailing pouch according to this invention overcomes the above identified problems and is readily adapted for mailing fragile goods which must be returned. The closure flap for the mailing pouch does not require any positive fastener means or the like to maintain the pouch closed during mail handling. The flap structure and the manner in which it closes the pouch is such that it provides for ready intended opening of the pouch and the flap is positioned within the pouch for pouch closure to reduce chances of the pouch being opened accidentally.

According to an aspect of the invention, the closure flap for the pouch has a resilient portion associated therewith which is sufficiently flexible to permit insertion of and withdrawal of the flap into and from the pouch mouth. The resilient portion is so associated with the flap to provide substantial initial resistance to flap pull out. Pull tab means is secured to the flap. The arrangement is such that with the flap tucked into the pouch mouth, the pull tab is located between the flap and the adjacent wall of the pouch. The pull tab provides a hand grasp to overcome initial resistance by the resilient portion to flap pull out to facilitate intended opening of the pouch.

According to a more detailed aspect of the invention, the mailing pouch comprises front and back walls joined at their sides and bottom to define a pouch mouth between top edges of the front and back walls. A pouch mouth closure flap with inner and outer surfaces is integral with one of the pouch walls and has a hinge area at the juncture of the flap base and pouch wall. The resilient portion associated with the flap extends from the hinge area to at least proximate the leading portion of the flap. The pull tab means is secured to the flap's outer surface near its leading portion and the tab extends back towards the flap's base.

The resilient portion associated with the flap has to be sufficiently flexible to permit insertion and withdrawal of the flap in closing and opening the pouch. On opening the pouch, the resilient portion has to arch or roll beginning at its base and then extending along its length while the flap is being withdrawn. The resistance to flap withdrawal is provided by the resistance the resilient portion has to deforming from its essentially planar configuration as it lies in the pouch mouth to an arched or rolled configuration. The degree of stiffness in the resilient portion therefore determines the degree of resistance to flap withdrawal when, as mentioned, the resilient portion has to be sufficiently flexible to allow opening and closing of the pouch.

These and other features and advantages of the invention will become apparent to those skilled in the art in the following detailed description of various preferred embodiments of the invention as shown in the drawings wherein.

DETAILED DESCRIPTION OF THE PREFERRED EMBODIMENTS OF THE INVENTION

Figure 1:
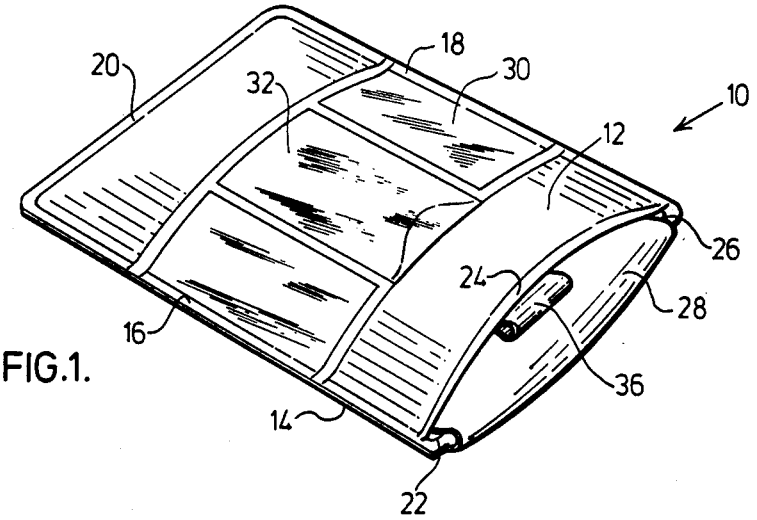
FIG. 1 is a view of the mailing pouch in it's closed position.

The mailing pouch 10 as shown in FIG. 1 is particularly suitable for use in return mail. The pouch comprises front and back walls 12 and 14 of thermoplastic sheet material which is heat sealed around the sides 16, 18 and the bottom 20 to provide a pouch mouth 22 defined by top edges 24 and 26 of the front and back walls 12, 14. The pouch mouth 22 is closed by tucking in the mouth a closure flap 28 which is integral with the back wall 14. In order to open the pouch a pull tab 36 is attached to the flap 28 which facilitates withdrawal of the flap from the pouch mouth to provide access to the pouch.

On the front wall 12 an area 30 is provided on which the return address for the material may be permanently indicated. Centrally of the front wall 12 is an envelope 32 into which a card may be slipped and flap 34 tucked underneath the card to retain it in the envelope 32. This card may present through the clear plastic of the envelope 32 the address to which the material is being sent.

Figure 5:
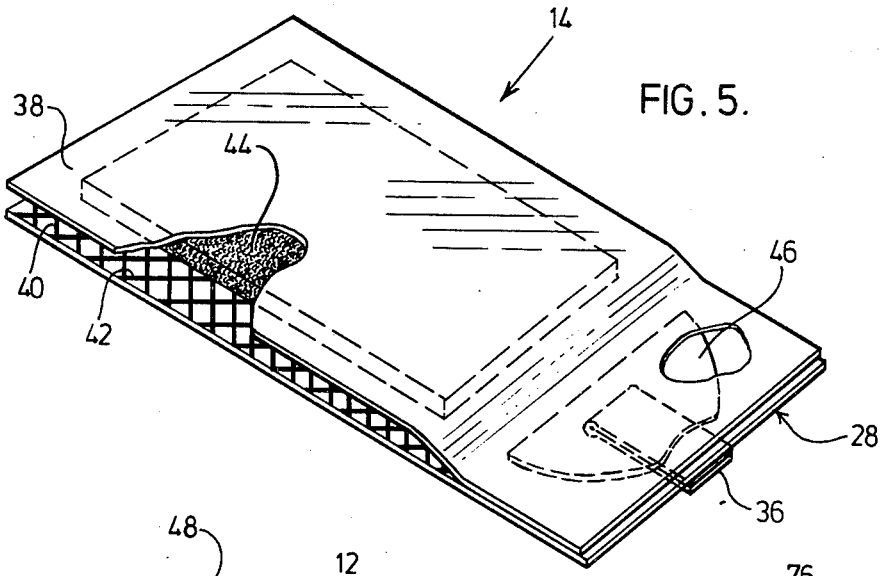
FIGS. 5, 6 and 7 illustrate a preferred mode of making the pouch according to this invention.
Figure 6:
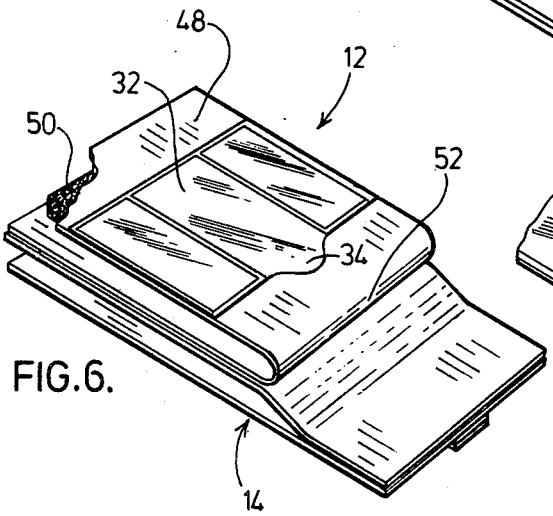
Figure 4:
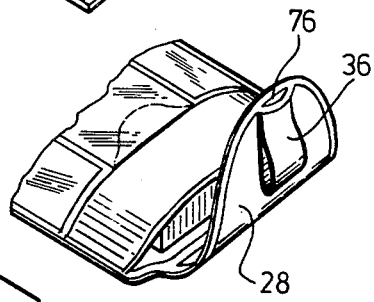
FIG. 4 shows the mouth area of the pouch of FIG. 1 where the flap is totally withdrawn.
Figure 7:
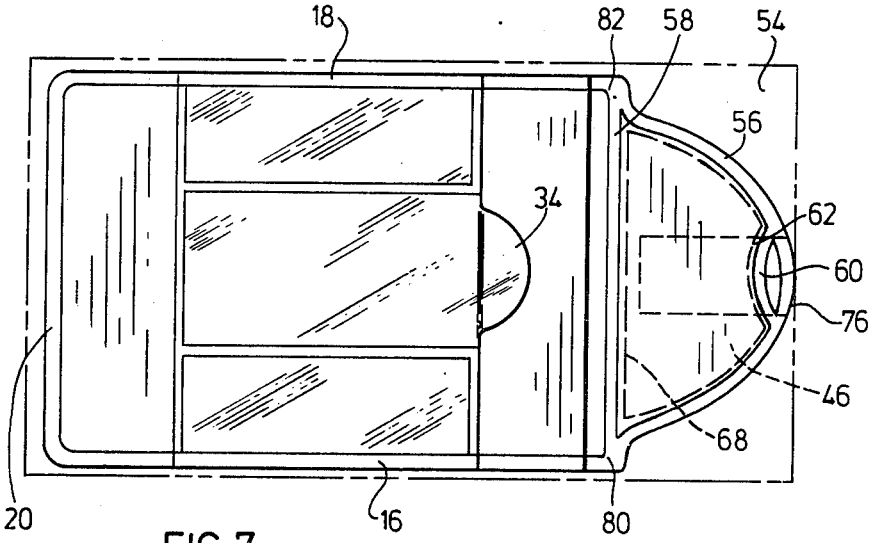

Before discussing the various features of the manner in which the pouch closure flap functions, the following discussion of a preferred mode of assembling the pouch should be helpful. Turning to FIGS. 5, 6 and 7 the pouch back wall 14 and the pouch flap 28 are formed from opposing layers of thermoplastic material 38 and 40. A preferred form of thermoplastic material is polyvinylchloride having a nylon fabric reinforcing 42. The material is cut in a manner so that the fabric reinforcing 42 diagonally intersects the edges of the layers 38 and 40 to increase tear resistance along the pouch edges. Sandwiched between the layers of material 38 and 40 is foam material 44 which provides impact or shock absorbance for the contents during mail handing. The foam also serves to thermally insulate the contents from the cold. A resilient insert 46 is provided between the layers of flap 28. On the outer face of layer 40 a pull tab 36 is located. The pull tab 36 in this embodiment consists of a single stripe of thermoplastic material laid over itself so that once attached to the flap, it provides a loop.

The front wall 12 of the pouch is laid over the back wall 14, as shown in FIG. 6. The front wall 12 consists of a sheet of material 48 which is the same as that used in the back wall 14. The sheet 48 is folded upon itself and sandwiched between it is a layer of foam material 50. Previously affixed to the front wall 12 is the mailing envelope 32. To facilitate folding of sheet 48, a score line 52 is provided mid-way to define a crease. Upon complete assembly of the pouch, the crease defines a rim or edge of the pouch opening.

The pouch as assembled is shown in FIG. 7. The layers of material are contacted with a heat sealing unit so that its rectangular configuration 54 as designated in dot in FIG. 7 is heat sealed in the areas shown to provide sealed sides 16, 18 and bottom 20. The outline of the flap is defined by heat seal 56. A hinge area for the flap is provided by heat seal 58 which isolates the insulation material 44 from the resilient member 46. The preferred manner of attaching the pull tab 36 to the outer surface of the flap involves attachment at the outer heat seal 56 and at inner arcuate heat seal 60 the shape of which coinsides with the dished portion 62 of resilient member 46.

Simultaneously with the heat sealing operation, shown in FIG. 7, the pouch may be dye cut from the blank portion 54 or the dye cut operation may be a step separate from that of the heat sealing operation.

The surfaces of the material 38 and 42 may have a roughened texture which is particularly advantageous in increasing frictional contact between the outer surface of flap 28 and the inner surface of the front wall 12 because in combination with the resilient portion 46 resistance to flap pull out is enhansed. The preferred polyvinylchloride with nylon reinforcing is particularly suitable for use in returnable mail pouches, due to its long wearing characteristics, resistance to cracking in cold weather and ability to withstand several flexing operations. The resilient insert 46 in the flap 28 may be of any suitable material which is sufficiently flexible to allow insertion and removal of the flap from the pouch mouth, retains its resiliency over extended periods of use such as 10,000 or more flap opening and closures, does not score or crease readily, and resists cracking in colder climates. The selection of the thickness and the type of resilient insert is also dependent upon the size of the pouch to be made, the length of the flap and the width of the flap. A preferred type of resilient insert is polyethalene which may have a thickness ranging from 20 to 40 thousands of an inch.

The heat sealed portions 56, 58 and 60 closely resemble the shape of the resilient insert 46. This ensures that the insert 46 does not move relative to the flap during opening and closing operations to thereby provide the initial resistance to flap pull out.

Figure 2:
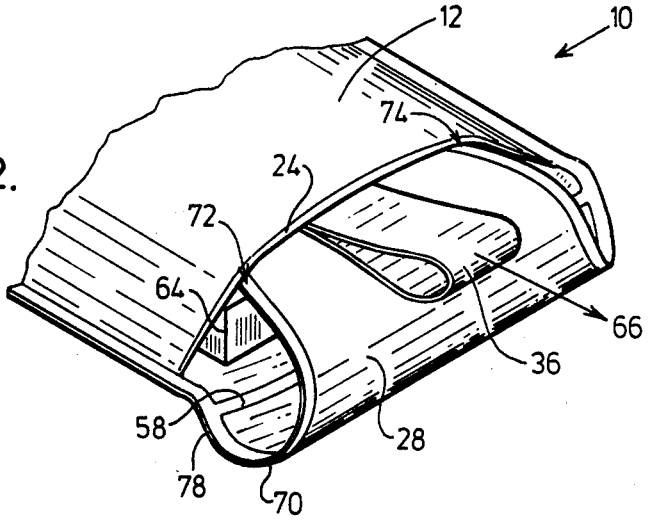
FIGS. 2 and 3 are views of the mouth of the pouch of FIG. 1 showing the pouch flap at progressive stages of withdrawal from the pouch mouth.
Figure 3:
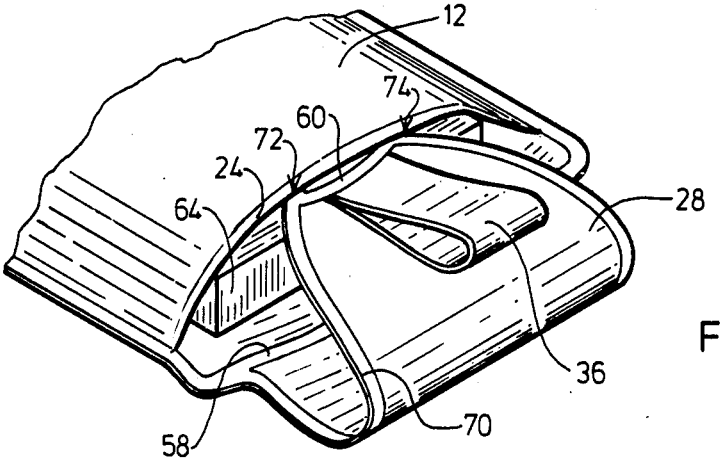

Turning to FIG. 2, the pouch 10 contains an item 64 where pull tab 36 is being pulled outwardly in the direction of arrow 66. The resilient insert 46 in the flap 28 provides initial resistance to flap pull out. As explained with respect to FIG. 7, the base 68 of the resilient insert 46 is essentially restricted in its movement along the flap's length between the flap outer and inner walls by heat seals 58 and 60. On attempting to pull the tab 36 outwardly, the resilient member 46 as it lies against heat seal 58 which constitutes the hinge area, resists being flexed out of its planar or essentially planar position as it lies within the pouch mouth. It is therefore difficult to remove the flap from the pouch however, pull tab 36 provides a hand grasp to facilitate pulling the flap out by flexing the resilient member into a curved or arched shape at it's lower end in a manner demonstrated in the area 70. Due to the arched configuration of the flap, the distance between the points generally designated 72 and 74 decreases. In so doing, this allows the front wall 12 to bulge outwardly to a greater extent. This action reduces the resistance to intended flap pull out as the resilient member 46 flexes over a longer distance. As the resilient member 46 rolls along the flap's length there is, in essence, an infinite hinge area formed along it's length.

Heat seal 60 forms an arcuate juncture of the pull tab 36 to the outer surface of flap 28. This type of attachment distributes the lines of force exerted over the length of the seal at the connection of tab to flap on pulling the tab 36 outwardly so that lines of force are not concentrated at the corners of the pull tab. This substantially reduces any chance of tearing the pull tab away from the flap 28 on flap withdrawal. The second heat seal 56 also provides a double attachment of the pull tab 36 to the flap to more positively secure the tab 36 to the flap.

The dished portion 62 of the resilient member 46 provides a leading edge 76 as shown in FIG. 7 which is substantially more flexible than the remainder of the flap. This provides for a flexible lead-in portion of the flap which is tucked under the edge 24 of the flap into the pouch mouth.

It can be appreciated that with this type of flap construction for a mailing pouch, the pouch is closed with a flap which is positioned internally of the pouch. This arrangement is not susceptible to accidental pouch opening due to catching of the flap during handling. Further there is no need for any positive locking or fastening means to retain the flap within the pouch which is particularly advantageous for use in mailing material to the handicapped. The pull tab 36 with it's looped portion, allows the insertion of a finger and then by simply pulling on the tab, the flap can be withdrawn from the pouch. Due to the properties of the flap 46 the repeated closing and opening of the pouch does not wear out or weaken the resilient member's resistance to pouch opening. Further such pouch closure allows Post Office inspection of the contents, without breaking any seals.

The length of the pull tab 36 may be such that when the flap is tucked within the pouch the tab falls short of edge 24. The pull tab 36 is therefore barely attainable or is completely hidden underneath the front wall 12, however a finger may be inserted between the flap and the front wall 12 to catch loop 36 and open the pouch.

According to a preferred embodiment of the invention, the width of the resilient insert 46 is narrower than the width of the back wall 14. This allows a somewhat downward flexing of the back wall in the area 78 as shown in FIG. 2 to provide for greater mouth expansion in withdrawing the flap 28 and to facilitate insertion and removal of the pouch contents.

Other various configurations for the flap 28 may be provided as would be understood by those skilled in the art, where a resilient portion is associated in one manner or another with the flap so as to be immoveable relative to the flap in opening and closing the pouch.

Depending upon the flap configuration it is also understood that a multiple of resilient portions may be associated with such flap. Such resilient portions would be located in the flap to function in a manner which provides the same advantages demonstrated by the resilient portion discussed and shown in the drawings.

The heat seal line 58 in the back wall 14 may be spaced outwardly of the edge of the front wall 12 which results in the back wall being longer than the front wall. The distance that it is spaced from the edge 24 of the front wall should not, however, be greater than the height or thickness of the contents 64 to be placed in the pouch. Additionally material may be provided in the areas 80 and 82 as shown in FIG. 7 to provide for complete pouch mouth closure when the flap is tucked within the pouch. The single score line 58 also enhances the storage of the pouches because with the flap inserted either in the pouch or left outwardly, the pouches may be stored flat to take up minimum space.

Although various features of the preferred embodiments of the invention have been described herein in detail, it will be understood that variations may be made thereto without departing from the spirit of the invention or the scope of the appended claims.

The embodiments of the invention in which an exclusive property or privilege is claimed are defined as follows:

1. A mailing pouch comprising front and back walls joined at their sides and bottom to define a pouch mouth between top edges of said front and back walls, a pouch mouth closure flap with inner and outer surfaces being integral with one of said pouch walls and having a hinge area at the juncture of flap base and pouch wall, said flap having a resilient portion associated therewith which extends from said hinge area to at least proximate the leading portion of said flap, pull tab means secured near the leading flap portion and to the flap's outer surface, said pull tab extending towards the flap's base, said resilient portion being sufficiently flexible to permit insertion of and withdrawal of said flap into and from said pouch mouth whereby with said flap in mouth closure position said pull tab is located between the pouch wall and the flap to provide a hand grasp in overcoming initial resistance by said resilient portion to flap pull out.

2. A mailing pouch of claim 1 wherein the flap outer surface and the pouch walls which is in contact with said flap are formed with roughened surfaces to enhance the resistance to flap pull out by increased frictional contact between such surfaces.

3. A mailing pouch of claim 1 wherein said flap is arcuate in shape with said resilient portion being of essentially identical shape.

4. A mailing pouch of claim 3 wherein the part of said resilient portion which is adjacent the leading portion of said flap is dished to provide a relatively more flexible flap leading edge portion.

5. A mailing pouch of claim 1 wherein said pull tab and said flap are of thermoplastic material, an arcuate heat seal joining said pull tab to said flap where the mid-portion of said seal is closest the flap base.

6. A mailing pouch of claim 1 wherein said pull tab is a loop of sufficient size to accommodate at least one finger.

7. A mailing pouch of claim 1 wherein said back wall is slightly longer than said front wall to thereby locate said hinge area outwardly of said front wall a distance not greater than the expected thickness of a parcel to be placed in said mailing pouch.

8. A mailing pouch of claim 1 wherein said front wall is of thermoplastic material, the free edge of said front wall including a score line.

9. A mailing pouch of claims 1, 3 or 4 wherein said resilient portion is a sheet of polyethylene of approximately 25 to 35 thousands of an inch thick.

10. A mailing pouch of claim 1 wherein said pull tab extends towards and is short of said hinge area so that with said flap in mouth closure position, the pouch wall overlies said pull tab.

11. A mailing pouch of claim 1 wherein the width of the base of said resilient portion is less than the width of the flap base.

12. A mailing pouch of claim 1 wherein said front and back wall top marginal edges are flexible.

13. A mailing pouch of claim 1 wherein the leading portion of said flap is narrower than its base.

14. A mailing pouch of claim 1 wherein said front and back walls include a layer of compressible resilient material sandwiched between two sheets of thermoplastic material, the flap consisting of two sheets of thermoplastic material integral with the two sheets of the corresponding pouch wall, said resilient portion being an insert between said two layers, a heat seal extending across said flap base to isolate said resilient portion from said compressible material.

15. A mailing pouch of claim 1 wherein said front, back walls and flap are of thermoplastic material which includes nylon thread reinforcing.

16. A mailing pouch of claim 14 wherein said resilient portion as inserted between the two layers of plastic of said flap, is essentially immoveable relative to said flap.

* * * * *